US009562335B1

(12) United States Patent
Arrington

(10) Patent No.: US 9,562,335 B1
(45) Date of Patent: Feb. 7, 2017

(54) FLOOD CONTROL DEVICES AND METHODS

(76) Inventor: Abron J. Arrington, Aurora, CO (US)

( * ) Notice: Subject to any disclaimer, the term of this patent is extended or adjusted under 35 U.S.C. 154(b) by 0 days.

(21) Appl. No.: 12/783,382

(22) Filed: May 19, 2010

Related U.S. Application Data

(60) Provisional application No. 61/180,036, filed on May 20, 2009.

(51) Int. Cl.
*E02B 7/14* (2006.01)
*E02B 3/10* (2006.01)
*E02B 3/04* (2006.01)

(52) U.S. Cl.
CPC *E02B 3/106* (2013.01); *E02B 3/04* (2013.01)

(58) Field of Classification Search
CPC ..... E02B 3/108; E02B 3/106; E02B 3/04; E02B 3/10
USPC ..... 405/110, 15, 16, 17, 18, 21, 19, 31, 32, 405/30, 111
See application file for complete search history.

(56) References Cited

U.S. PATENT DOCUMENTS 954,283 A * 4/1910 Hawkes ..... 405/21
1,097,916 A * 5/1914 Church ..... 405/110
4,136,995 A * 1/1979 Fish ..... 405/115
4,889,446 A * 12/1989 Holmberg ..... 405/19
4,921,373 A * 5/1990 Coffey ..... 405/115
5,174,681 A * 12/1992 Atkinson et al. ..... 405/34
5,176,468 A * 1/1993 Poole ..... 405/23
5,224,794 A * 7/1993 Atkinson et al. ..... 405/32
5,439,316 A * 8/1995 Richardson ..... 405/114
5,632,573 A * 5/1997 Baker ..... 405/111
5,658,096 A * 8/1997 Von Kanel ..... 405/302.4
5,775,838 A * 7/1998 Pettee, Sr. ..... 405/20
5,971,661 A * 10/1999 Johnson et al. ..... 405/114
6,250,845 B1 * 6/2001 Deaton et al. ..... 405/33
6,334,736 B1 * 1/2002 Johnson et al. ..... 405/114
6,672,799 B2 * 1/2004 Earl ..... 405/111
6,676,333 B2 * 1/2004 Wiseman et al. ..... 405/114
6,679,654 B1 * 1/2004 Wittenberg et al. ..... 405/115
6,692,188 B1 * 2/2004 Walker et al. ..... 405/115
6,840,711 B1 * 1/2005 Martinez et al. ..... 405/107
6,932,539 B2 * 8/2005 Benedict ..... 405/34
7,708,495 B1 * 5/2010 Antee ..... 405/114
7,712,998 B2 * 5/2010 Salemie ..... 405/111
(Continued)

OTHER PUBLICATIONS

Hellevang, Kenneth, "Sandbagging for Flood Protection" North Dakota State University Extension Service Mar. 2009, AE-626 (Revised), 4 pgs.

*Primary Examiner* — Sean Andrish
*Assistant Examiner* — Patrick Lambe
(74) *Attorney, Agent, or Firm* — Blakely, Sokoloff, Taylor & Zafman LLP

(57) ABSTRACT

Flood control apparatus are disclosed. In one aspect, a flood control apparatus includes a structural frame. The structural frame has an elongated length in a longitudinal direction. The structural frame includes a plurality of transverse support structures, that are generally aligned in the transverse direction, and that are spaced apart in the longitudinal direction. The structural frame includes one or more longitudinal coupling structures that couple the plurality of transverse support structures together. One or more sheets of material are coupled to the structural frame. When in use, earth may be used to substantially fill an inner region of the apparatus that is enclosed by the one or more sheets of material coupled to the structural frame.

13 Claims, 13 Drawing Sheets

(56) References Cited

U.S. PATENT DOCUMENTS

| | | | | |
|---|---|---|---|---|
| 2002/0048491 | A1* | 4/2002 | Dery | 405/115 |
| 2003/0035690 | A1* | 2/2003 | Earl | 405/107 |
| 2007/0154264 | A1* | 7/2007 | Baruh | 405/110 |
| 2010/0202828 | A1* | 8/2010 | Ashmead | E01F 13/02 404/6 |

* cited by examiner

FLOOD CONTROL DEVICES AND METHODS

RELATED APPLICATIONS

The present application claims priority from U.S. Provisional Patent Application Ser. No. 61/180,036, entitled "FLOOD CONTROL DEVICES AND METHODS," filed on May 20, 2009, by Abron J. Arrington. U.S. Provisional Patent Application Ser. No. 61/180,036 is hereby incorporated herein by this reference.

BACKGROUND

Field

Embodiments of the invention relate to a water or flood control device, or method of making, assembling, or using the water or flood control devices, or a kit therefor.

Background Information

A flood generally refers to an overflow of water from a river, lake, or other body or expanse of water. When the water overflows, it escapes its normal boundaries, and flows onto normally dry land.

There are various causes of floods. As one example, runoff from sustained or heavy rainfall, or rapid snow melt, may cause the water level in a river to rise until it exceeds the capacity of the rivers channel, which may cause a flood. As another example, an obstruction, such as, for example, ice or a landslide, may obstruct a river channel, which may cause flooding upstream of the obstruction. These are just a few examples. As yet another example, a flood may occur when a levy or dike is damaged.

Such floods, especially when they occur in populated areas, are generally undesirable. The floods may cause significant damage to homes, businesses, vehicles, farms, and the like. In addition, in severe cases, the floods may place human life at risk.

One commonly used approach to attempt to lessen the effects of a flood involves the use of sandbags. Sandbags, which are also sometimes referred to as floodbags, generally refer to sacks made of hessian/burlap, polypropylene, or like materials, which are filled with sand or soil. The sandbags may be brought in empty to a location where a flood is occurring, or may potentially occur, and filled on site with local sand or soil. Once filled, the sandbags may be placed, and in some cases stacked in multiple levels, along a boundary of a body or expanse of water, such as, for example, a river bank. Sandbags generally tend to prevent or at least reduce the effects of a flood.

However, one potential drawback with the use of sandbags is that the sandbags tend to be relatively slow and labor intensive to deploy. Each bag generally needs to be filled with sand or soil on site, which may take a significant amount of time.

Accordingly, alternate ways of reducing the effects of floods, or preventing the detrimental effects of flood waters, or alternate flood control devices and methods besides those based on sandbags, would offer certain advantages.

BRIEF DESCRIPTION OF THE SEVERAL VIEWS OF THE DRAWINGS

The invention may best be understood by referring to the following description and accompanying drawings that are used to illustrate embodiments of the invention. In the drawings:

FIG. 2A is a front view. FIG. 2B is a top view. FIG. 2C is a side view.

DETAILED DESCRIPTION

In the following description, numerous specific details are set forth. However, it is understood that embodiments of the invention may be practiced without these specific details. In other instances, well-known structures and techniques have not been shown in detail in order not to obscure the understanding of this description.

Embodiments of flood control apparatus, methods, and kits are disclosed herein. Commonly an embodiment of a flood control apparatus may include a structural frame having an elongated length in a given direction. Commonly, the structural frame may be capable of being coupled together to form an elongated length of at least 100 feet. Commonly, a width of the apparatus or structural frame is at least 2 feet, or longer. Commonly, a height of the apparatus or structural frame is 2 feet, or higher. One or more sheets of material may be coupled around the structural frame. A hollow or void inner region may exist within the one or more sheets of material that may be filled or substantially filled with earth. The one or more sheets may help to retain the earth. The flood control apparatus may be helpful for controlling or restraining floods. Methods of assembling and using the flood control apparatus, as well as kits useful in assembling the flood control apparatus, are also disclosed.

Figure 1:
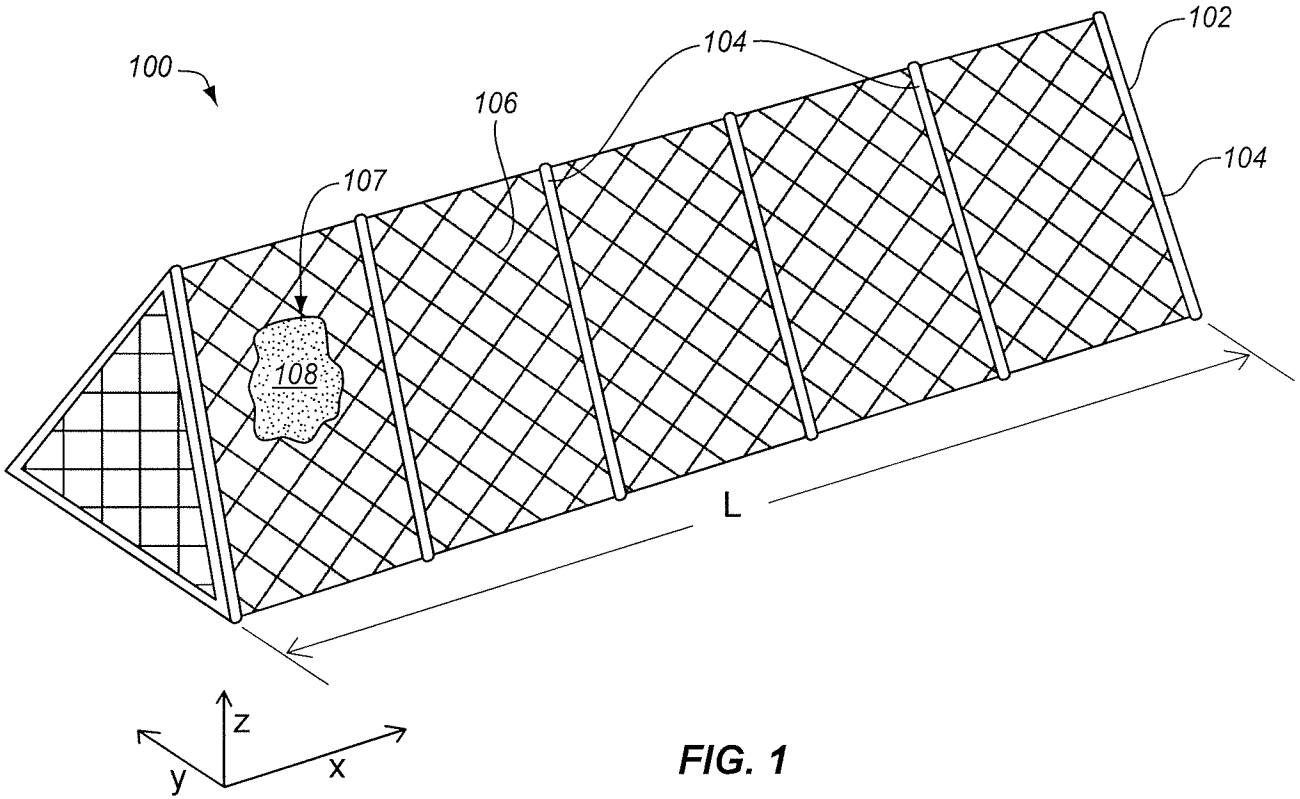
FIG. 1 is a perspective view of an embodiment of a flood control apparatus.

FIG. 1 is a perspective view of an embodiment of a flood control apparatus 100.

The flood control apparatus has a structural frame 102. The structural frame may represent a structure that gives shape and/or strength to the apparatus.

The apparatus and the structural frame have an elongated length (L) in a longitudinal direction. The longitudinal direction runs along the major or longest dimension or axis of the apparatus.

For purposes of illustration, a relatively short length flood control apparatus is illustrated. However, typically the flood control apparatus may be much longer. By way of example, depending on need, in various embodiments, additional lengths similar to the illustrated length may be coupled to achieve a length of at least 100 feet, at least 200 feet, at least 500 feet, at least 1000 feet, at least ¼ mile, at least ½ mile, or longer.

The apparatus and the structural frame also have a generally triangular cross-sectional shape in a transverse direction. The transverse direction runs across, or is substantially at a right angle to, the longitudinal direction along a width of the apparatus. The generally triangular cross-sectional shape may differ from a triangle by having legs, having a cut or rounded top or apex, or the like. Typically the generally triangular shape may be regarded as overall triangular or having at least 70% of the shape being triangular.

In various embodiments, a width of the apparatus in the transverse direction may range from about 2 to about 12 feet, often from 3 to 10 feet. For example, in one particular embodiment, the width may be about 4 feet. As another example, in another particular embodiment, the width may be about 9 feet. These are just a few illustrative examples.

The apparatus and the structural frame also have a height in a vertical direction. In one or more embodiments, a ratio of the width to the height is greater than one. For example, in one or more embodiments, the ratio of the width to the height may range from about 1.5 to about 3.5, or from about 1.5 to about 2.5, or be about 2. For example, in one particular embodiment, the height may be about 2 feet. As another example, in another particular embodiment, the width may be about 4.5 feet. These are just a few illustrative examples.

In the illustration, an x-axis shows the longitudinal direction, a y-axis shows the transverse direction, and a z-axis shows a vertical direction.

Referring again to FIG. 1, the structural frame includes a plurality of generally triangular shaped transverse support structures 104. Six generally triangular shaped transverse support structures are shown in the illustrated embodiment, although fewer or more may be included in alternate embodiments. The generally triangular shaped transverse support structures are generally aligned in the transverse (y-axis) direction and are spaced apart in the longitudinal (x-axis) direction. In one or more embodiments, the spacing between the generally triangular shaped transverse support structures ranges from about 2 to about 10 feet, often from about 3 to about 9 feet, in some cases from about 4 to about 8 feet.

The structural frame includes one or more longitudinal coupling structures, such as, for example, braces (not shown in the illustrated view). The one or more longitudinal coupling structures are generally aligned in the longitudinal direction. The one or more longitudinal coupling structures couple the plurality of transverse support structures together. The braces or longitudinal coupling structures may be located at various locations of the triangular shaped transverse support structures, such as, for example, along a leg, at a bottom, at the top, or some combination.

The flood control apparatus also includes one or more sheets of material 106, such as, for example, fabric or cloth. The one or more sheets of material are coupled with the structural frame 102.

Examples of suitable materials for the sheets include, but are not limited to, woven polypropylene, other woven plastics, un-woven flexible plastic sheets, burlap, duck cloth, duck canvas, canvas, cotton duck, woven cotton fabric, linen duck, jupe, other woven fabrics, other fabrics, other cloths, other materials sandbags are made out of, and combinations thereof. If desired, any of such materials may be coated with cement, paints, or other protective coatings. The sheets may optionally be reinforced through stitching, other reinforcements, etc.

The one or more sheets are coupled with the frame. Examples of suitable couplers include, but are not limited to, rivots (e.g., ¼" diameter 2" length plastic or aluminum rivots), screws, bolts, staples, hook-and-loop fasteners (e.g., VELCRO brand hook-and-loop fasteners), and the like, and combinations thereof.

In various embodiments, the sheet may be in the form of a normal rectangular sheet "wrapped" around the frame, a plurality of rectangular sheets applied separately, a cylindrical sock or tube, or a triangular sock or tube.

The one or more sheets of material coupled with the structural frame define an inner space or region. That is, the frame and one or more sheets of material enclose a generally hollow or void region within the apparatus.

In the illustration, a cut-out 107 is used to show that when deployed or in use, this hollow or void inner region or space may be substantially filled with earth 108. As used herein, "substantially filled" means filled by at least 70% by volume. Often, the apparatus may be "substantially completedly filled", meaning filled by at least 90%. The term "earth", as used herein, is intended to encompass soil, dirt, sand, clay, rocks, and the like, and combinations thereof.

A representative method of using the flood control apparatus will now briefly be described. Initially, the flood control apparatus may be transported unassembled to a location of a flood, or a location of a suspected or potential flood. Often, this location may be along a boundary of a body or expanse of water, such as, for example, along a river bank or along a bank of a lake or levy, etc.

The flood control apparatus may be assembled or put together at this location. In one or more embodiments, assembling the flood control apparatus may include assembling the frame, and in some cases coupling the one or more sheets with the frame. Other methods are also contemplated and some will be discussed further below. In one or more embodiments, the longitudinal or major axis of the flood control apparatus may be generally aligned with the natural boundary of the body or expanse of water. For example, the longitudinal axis of the flood control apparatus may be generally aligned (meaning within about 15 degrees) with a river bank, shoreline, length of a levy, etc.

The flood control apparatus may be assembled segment-by-segment. Once properly assembled, the flood control apparatus may be substantially filled or substantially completely filled with earth. For example, dirt may be shoveled manually into the internal void through a flap or other opening or through an opening before the sheets are fully coupled to the frame. As another example, a backhoe or other dirt-moving machine may be used to introduce earth into the internal void of the flood control apparatus.

Advantageously, the present inventor hopes and believes that the flood control apparatus should be capable of being deployed relatively rapidly compared to the use of sandbags. Rather than needing to fill each sandbag separately, and stack and configure the sandbags, a flood control apparatus designed for rapid assembly and deployment may be assembled and then filled with earth faster than separate sandbags could be filled. The present inventor hopes and believes that such rapid deployment may help to reduce the amount of time needed to fully set up a flood control system, which my help to alleviate or at least reduce the detrimental effects of a flood.

Figures 2A, 2B, 2C:
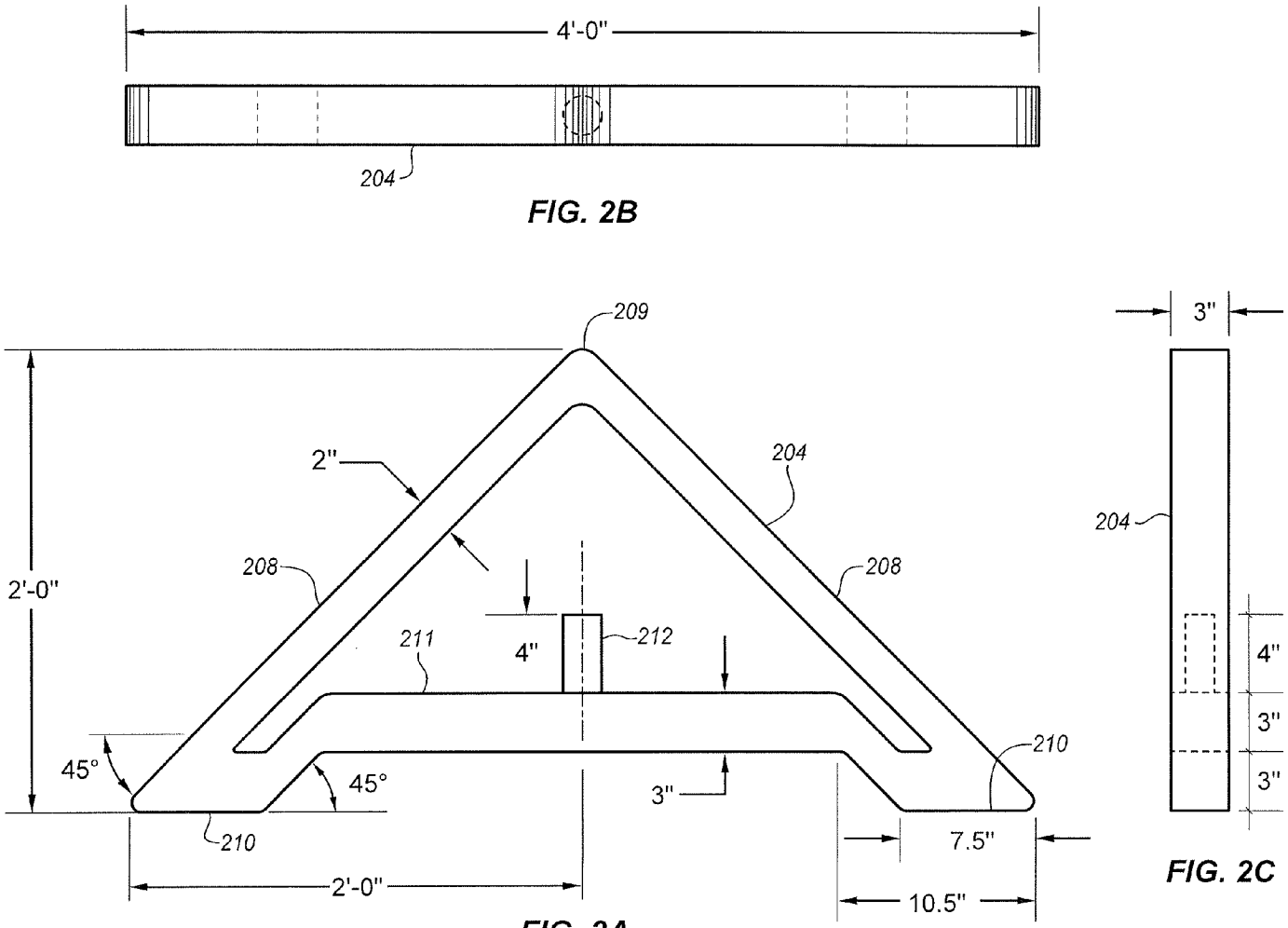
FIGS. 2A-2C show an embodiment of a generally triangular shaped transverse support structure.

FIGS. 2A-2C show an embodiment of a generally triangular shaped transverse support structure 204. The generally triangular shaped transverse support structure 204 is one embodiment suitable for the generally triangular shaped transverse support structure 104 shown in FIG. 1.

FIG. 2A is a front view of the embodiment of the generally triangular shaped transverse support structure 204. FIG. 2B is a top view. FIG. 2C is a side view.

As best shown in FIG. 2A, the support structure may include an A-frame. The A-frame may represent a support structure that is shaped generally like the letter "A".

The A-frame has two legs 208 that are coupled at a top 209. The two legs diverge downward at an angle relative to one another and terminate at two feet 210. The feet are intended to rest on the ground.

The illustrated A-frame has elongated feet to provide enhanced stability or good footing. Representatively, in one or more embodiments, a length of the feet may range from about 4 to about 18 inches, or longer. Often, the length of the feet may be at least 5, at least 6, or at least 7 inches long. As one example, in one particular embodiment, the length of the feet may be about 7.5 inches for a 4 foot wide A-frame. As another example, in one particular embodiment, the length of the feet may be about 15 inches for a 9 foot wide A-frame.

If desired, a width of the feet may also optionally be increased to further provide good footing or stability. If desired, the feet may optionally include an opening, such as, for example, a ring, through which a stake or other member may be driven into the ground to further secure the apparatus to one place.

The illustrated A-frame also has a crossmember 211. In this particular case, the crossmember couples bottom portions of the legs with one another. In this particular case, the crossmember is elevated off the ground by several inches. Alternatively, the crossmember may be on the ground and connect the feet.

The A-frame also includes a brace coupling device or member 212. As will be discussed further below, a brace may be coupled to the A-frame at the brace coupling device or member.

In the particular illustrated embodiment, the brace coupling device or member comprises a male member, such as, for example, a dowel-like, rod-like, or otherwise generally cylindrical projection that projects upward from the crossmember 211. A female member of the brace may be introduced over or otherwise mated with the male member to couple the brace with the A-frame.

The illustrated A-frame has a width of about 4 feet and a height of about two feet, although as discussed above this is not required. The angle of the legs is about 45 degrees, although this is not required. The length of the feet is about 7.5 inches, although as discussed above this is not required. A length of the male member 212 is about 4.5 inches, although it may be longer or shorter. A thickness of the A-frame, as best shown in FIG. 2C, is about 3 inches, although this is not required and it may generally range from about 1 to about 5 inches depending upon the strengths of the materials.

The A-frames may be fabricated with various different materials as long as the materials provide sufficient strength to the flood control apparatus. Examples of suitable materials for the A-braces include, but are not limited to, plastics, fiberglass and other fiber reinforced plastics, metals (e.g., metal pipes or beams), woods, and the like, and combinations thereof. Examples of suitable metals include, but are not limited to, aluminum, iron, carbon steel, stainless steel, and the like. In one example embodiment, at least a majority or all of the A-frame may be single injection molded plastic part. In another example embodiment, at least a majority or all of the A-frame may be single cast aluminum part.

Figure 2D:
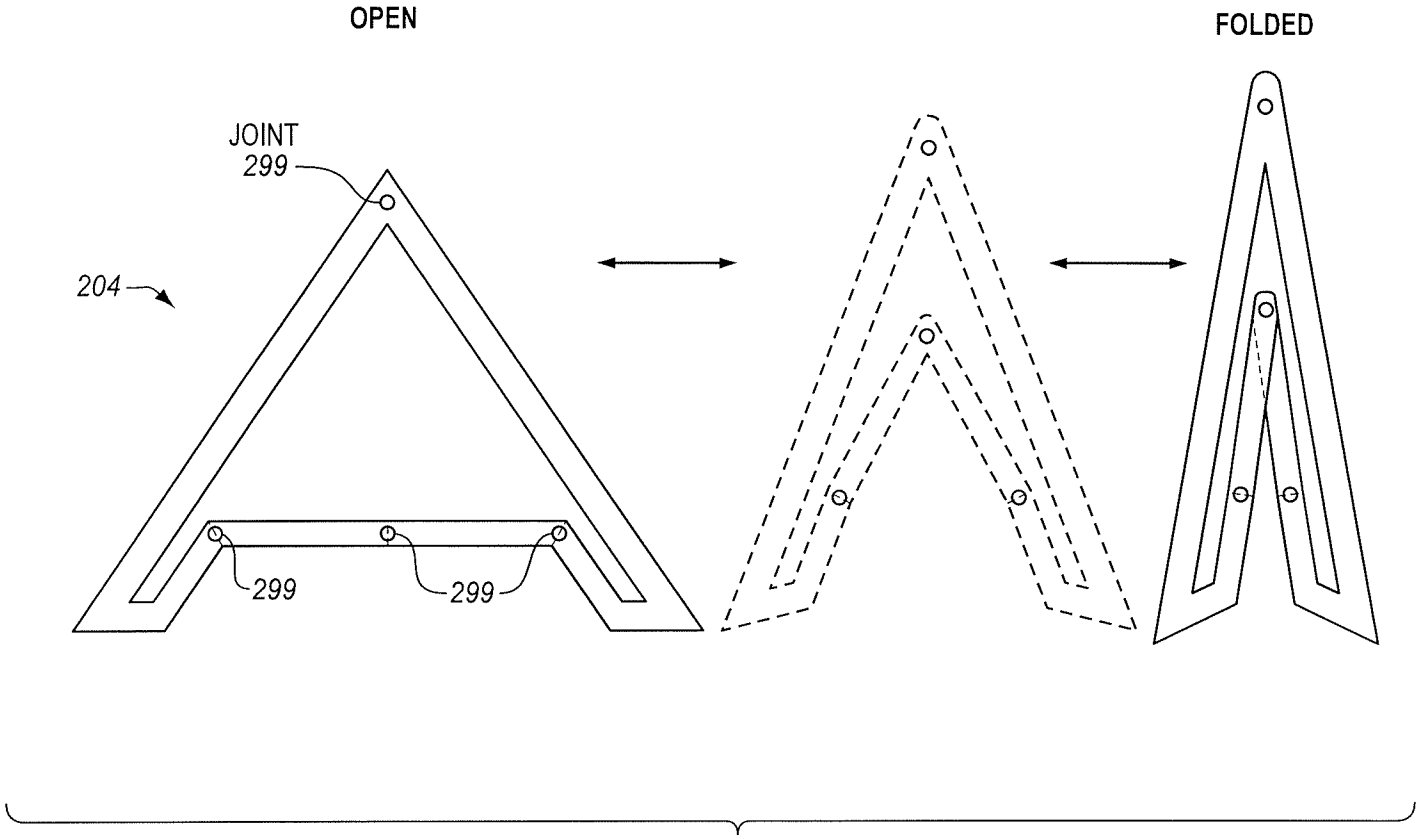
FIG. 2D is a front view showing an embodiment of a generally triangular shaped transverse support structure or A-frame optionally having four pivot joints which is optionally capable of folding from an open configuration (shown on the left) through an intermediate folded configuration (shown in the middle) to a fully folded or closed position (shown on the right).

FIG. 2D is a front view showing an embodiment of a generally triangular shaped transverse support structure or A-frame 204 optionally having four pivot joints 299 which is optionally capable of folding from an open configuration (shown on the left) through an intermediate folded configuration (shown in the middle) to a fully folded or closed position (shown on the right). The folding aspect may facilitate storage and/or carrying, for example.

Figure 3:
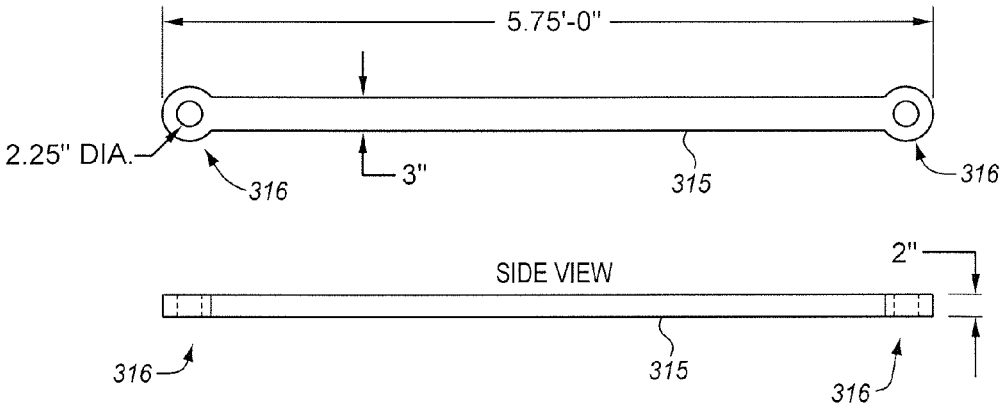
FIG. 3 shows an embodiment of a brace from a top view (on the top in the illustration) and a side view (on the bottom in the illustration).

FIG. 3 shows an embodiment of a brace 315 from a top view (on the top in the illustration) and a side view (on the bottom in the illustration). The brace represents one particular example of a suitable longitudinal coupling structure such as described above in conjunction with FIG. 1.

The brace is elongated. By way of example, in various embodiments, a length of the brace may range from about 2 to about 10 feet, often from about 3 to about 9 feet, in some cases from about 4 to about 8 feet. In the particular illustrated embodiment, the elongated length is about 5.75 feet.

The brace has a width of about 3 inches and a thickness of about 2 inches. However, these dimensions may be smaller or larger depending upon the length and the strength of the material used to make the brace.

The brace has a left generally cylindrical hole or other female member 316 at a left end thereof and a right generally cylindrical hole or other female member 316 at a right end thereof. The left female member may couple or connect to a first male member representing a brace coupling device or member of a first A-frame. The right female member may couple or connect to a second male member representing a second brace coupling device or member of a second first A-frame. By way of example, the holes may have diameters slightly greater than diameters of the male members. In the illustrated embodiment, the inside diameter of the holes is about 2.25 inches. The brace may be coupled to the A-frames in constructing the frame of the apparatus. The brace may be capable of being coupled and in some cases decoupled from the crossmembers. The braces help to connect and strengthen the frame.

Figure 4:
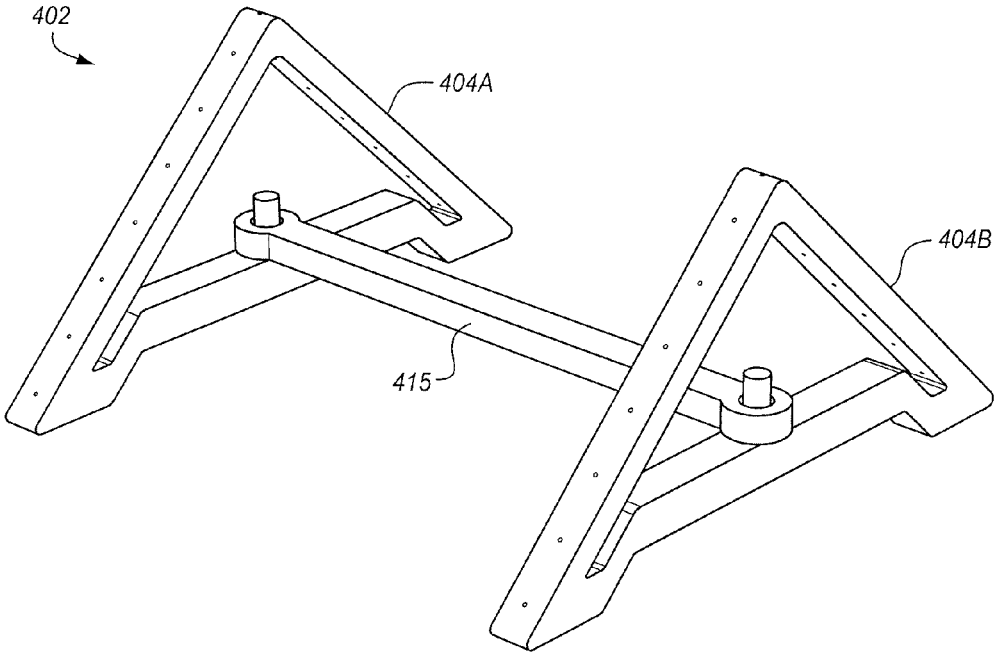
FIG. 4 is a perspective viewing showing an embodiment of a frame including a brace connecting a first A-frame and a second A-frame.

FIG. 4 is a perspective viewing showing an embodiment of a frame 402 including a brace 415 connecting a first A-frame 404A and a second A-frame 404B. The brace represents an example longitudinal coupling structure. In this particular case, the brace couples crossmembers of the A-frames. Alternatively, the brace may couple tops, bottoms, or sides of the A-frames, or braces may be included in multiple of such locations. The illustrated frame has a sawhorse-like design in which the brace need not necessarily be on the top.

Figure 5:
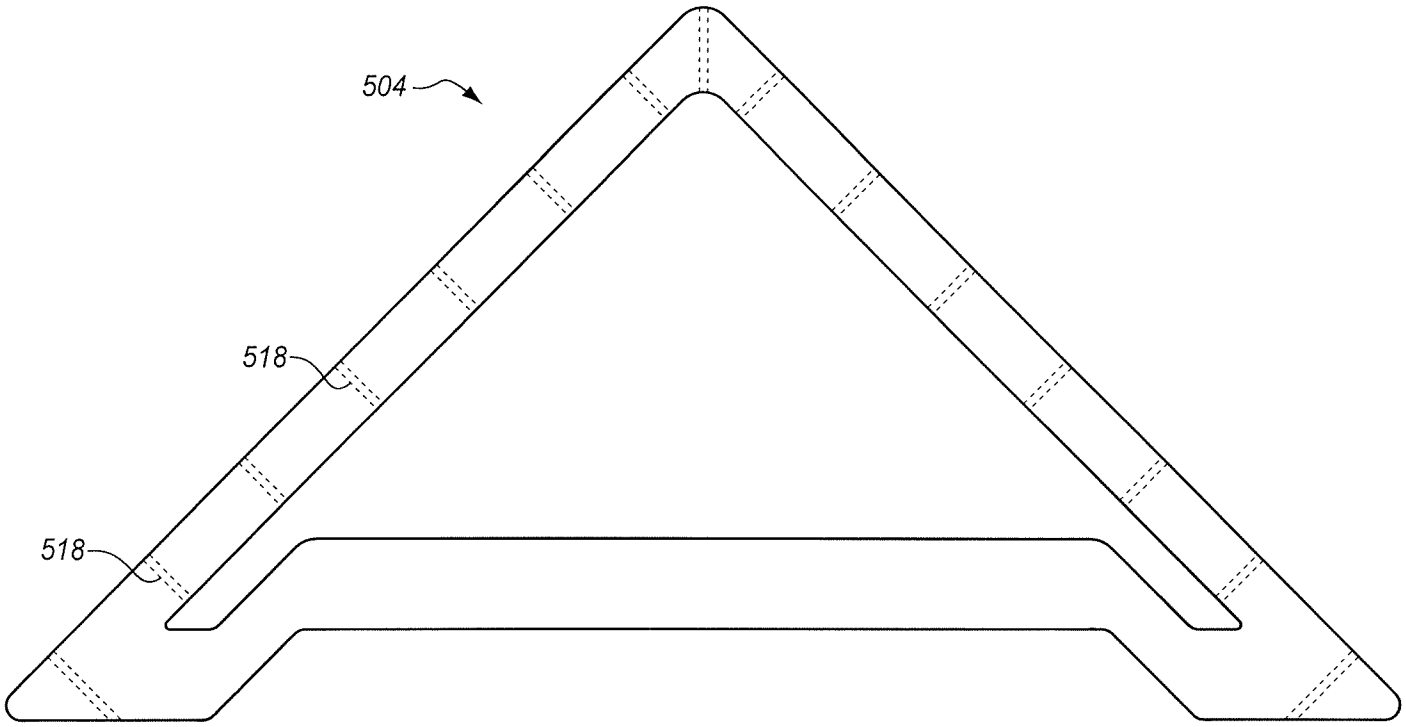
FIG. 5 is a cross-sectional side view through the middle of an embodiment of an A-frame having a plurality of generally cylindrical holes formed in the A-frame.

FIG. 5 is a cross-sectional side view through the middle of an embodiment of an A-frame 504 having a plurality of generally cylindrical holes 518 formed in the A-frame. In one or more embodiments, the holes may be used to secure one or more panels and/or sheets to the frame and/or the A-frame. For example, one or more panels and/or one or more sheets may be laid on the side of the A-frame. Then, rivots, screws, bolts, nails, or other male members may be introduced into the holes to secure or fasten the one or more sheets and/or panels to the A-frame. In one particular embodiment, the holes may be 0.25 inch cylindrical holes drilled all the way through the thickness of the A-frame.

Figure 6:
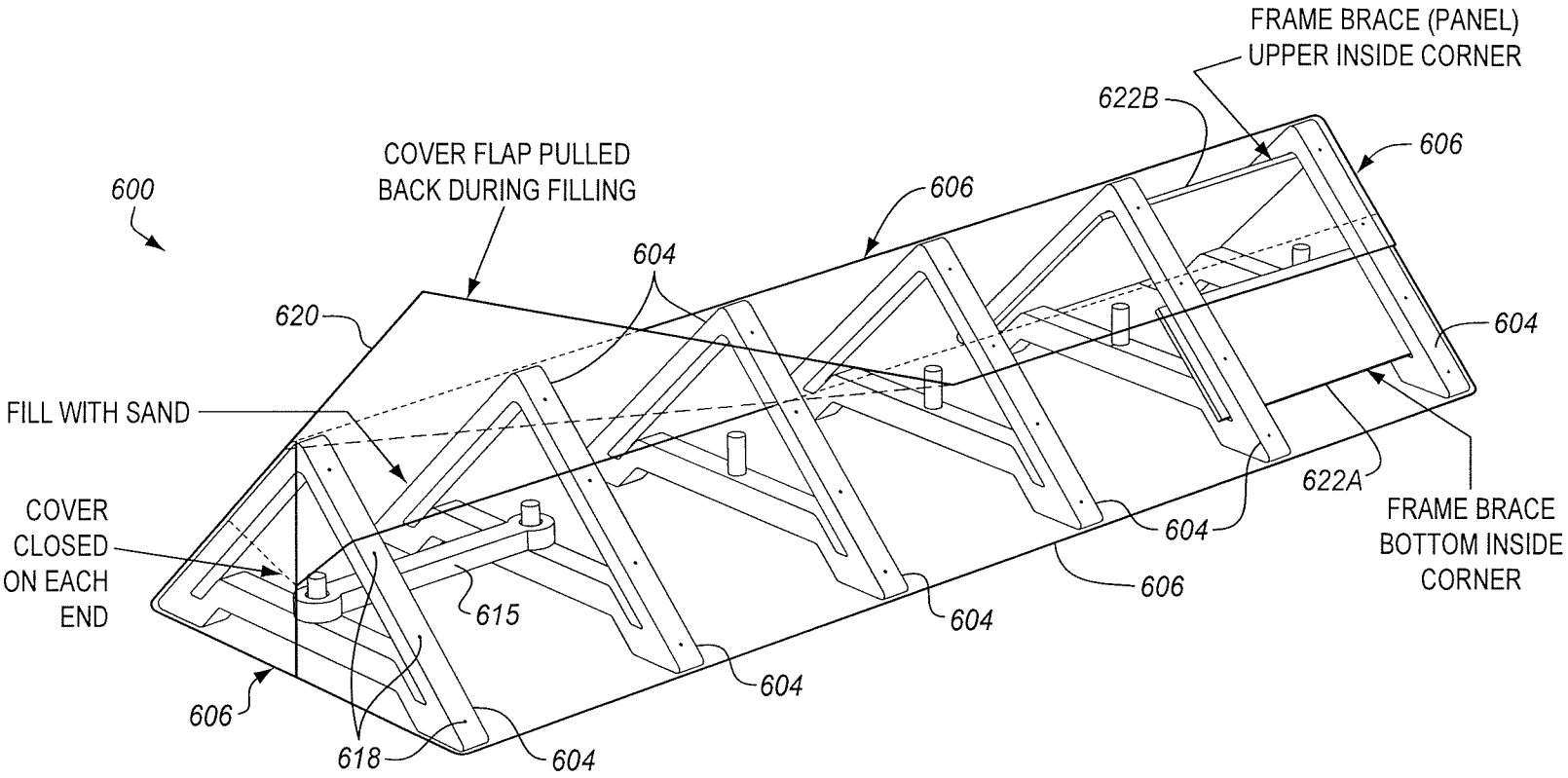
FIG. 6 is a perspective view of an embodiment of a flood control apparatus.

FIG. 6 is a perspective view of an embodiment of a flood control apparatus 600.

The flood control apparatus has a structural frame that includes a plurality of generally triangular shaped transverse support structures 604. Six generally triangular shaped transverse support structures (e.g., A-frames) are shown in the illustrated embodiment, although fewer or more may be included in alternate embodiments. The generally triangular shaped transverse support structures are generally aligned in a transverse direction and are spaced apart in a longitudinal direction.

The structural frame includes one or more braces or other longitudinal coupling structures 615. For simplicity, in the illustration only one brace is shown, although it is to be appreciated that braces may be used to couple most, a vast majority, or all of the triangular shaped transverse support structures. The brace is generally aligned in the longitudinal direction and couples crossmembers of adjacent A-frames. Other locations for such braces, such as, for example, at the top of the A-frames, at the bottoms of the A-frames, on the sides of the A-frames, and combinations thereof are also suitable.

The flood control apparatus also includes one or more sheets of material 606, such as, for example, fabric or cloth. In the illustration, the one or more sheets are shown as transparent or semi-transparent in order that the details of the frame may be better viewed. The one or more sheets of material are coupled with the frame. In the particular illustrated embodiment, the one or more sheets are coupled with the support structures through male members inserted through the one or more sheets and into holes 618.

A pulled back flap 620 is used to show an inner space or region defined by the one or more sheets applied over the frame. Sand or other earth may be introduced into the flap to substantially or completely fill the space or region. If desired, one or more optional vertical baffles, vertically opening compartments, honeycomb-like structures, or the like, may optionally be included within the compartment to help to stabilize, reinforce, or provide additional structure to the earth inside the apparatus.

As shown, in one or more embodiments, to provide additional strength or support, one or more rigid panels 622A, 622B may be coupled with the frame. For example, one or more rigid panels may be coupled with the transverse support structures. The rigid panels may represent thin, rigid, generally rectangular sheets of material, such as, for example, wood (e.g., plywood), plastic, metal, or the like. Often, the panels may have a length of around several feet and a width ranging from about one to several feet. One particular example of a suitable panel is a thin rectangular sheet of plywood having a length of about 5.5 feet, a width of about 3.75 feet, and a thickness of about 0.5 inches.

Figure 7B:
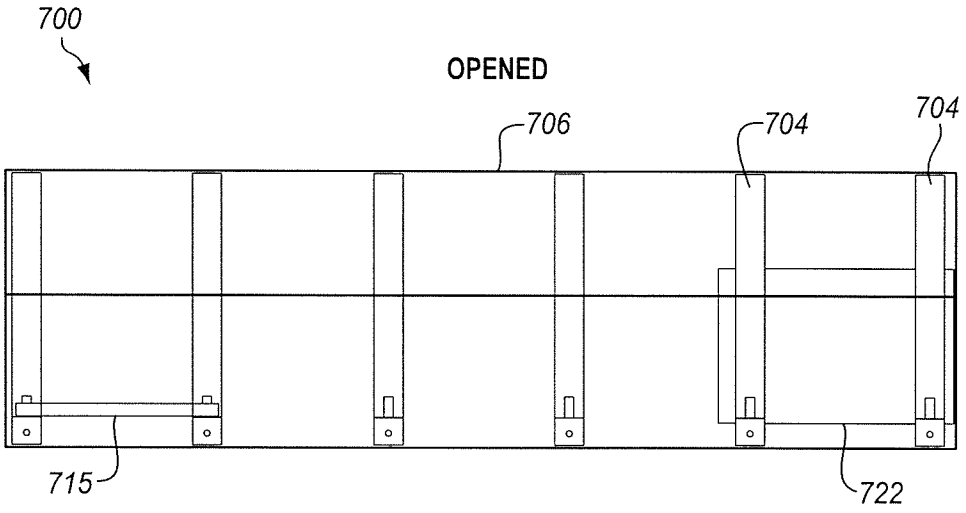
FIGS. 7A-B are side views illustrating an embodiment of an accordion-like or otherwise expandable flood control apparatus.
Figure 7A:
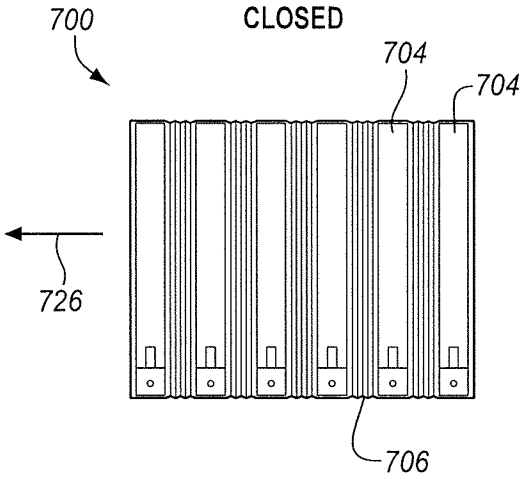

FIGS. 7A-B are side views illustrating an embodiment of an accordion-like or otherwise expandable flood control apparatus 700. FIG. 7A shows the expandable flood control apparatus in a compressed, contracted, or closed configuration. FIG. 7B shows the expandable flood control apparatus in an expanded or open configuration.

Referring first to FIG. 7A, the flood control apparatus includes a plurality of generally triangular shaped transverse support structures 704. The generally triangular shaped transverse support structures are generally aligned in a transverse direction and are spaced apart in a longitudinal direction.

One or more sheets of material 706, such as, for example, fabric or cloth, are coupled with the generally triangular shaped transverse support structures. Note that in this embodiment the one or more sheets are coupled with the support structures in the closed as well as the open position. They coupling may be semi-permanent or persistent. Note that portions of the one or more sheets between the generally triangular shaped transverse support structures may have folds or pleats to provide for expansion.

The closed flood control apparatus shown in FIG. 7A may be opened or expanded by pulling on it or otherwise extending it in the direction of arrow 726.

FIG. 7B shows the flood control apparatus 700 in an expanded position. As shown, the folds or pleats in the one or more sheets have been stretched out as the length of the apparatus has increased. As shown, one or more braces 715 and/or panels 722 may now be coupled with the apparatus, as previously described.

One potential advantage of the expandable flood control apparatus is faster deployment. The apparatus may be stored in a partially assembled state, but in a compact size, and then more rapidly deployed when needed. As discussed above, such rapid deployment may offer the possibility of reducing the detrimental effects of floods.

Figure 8:
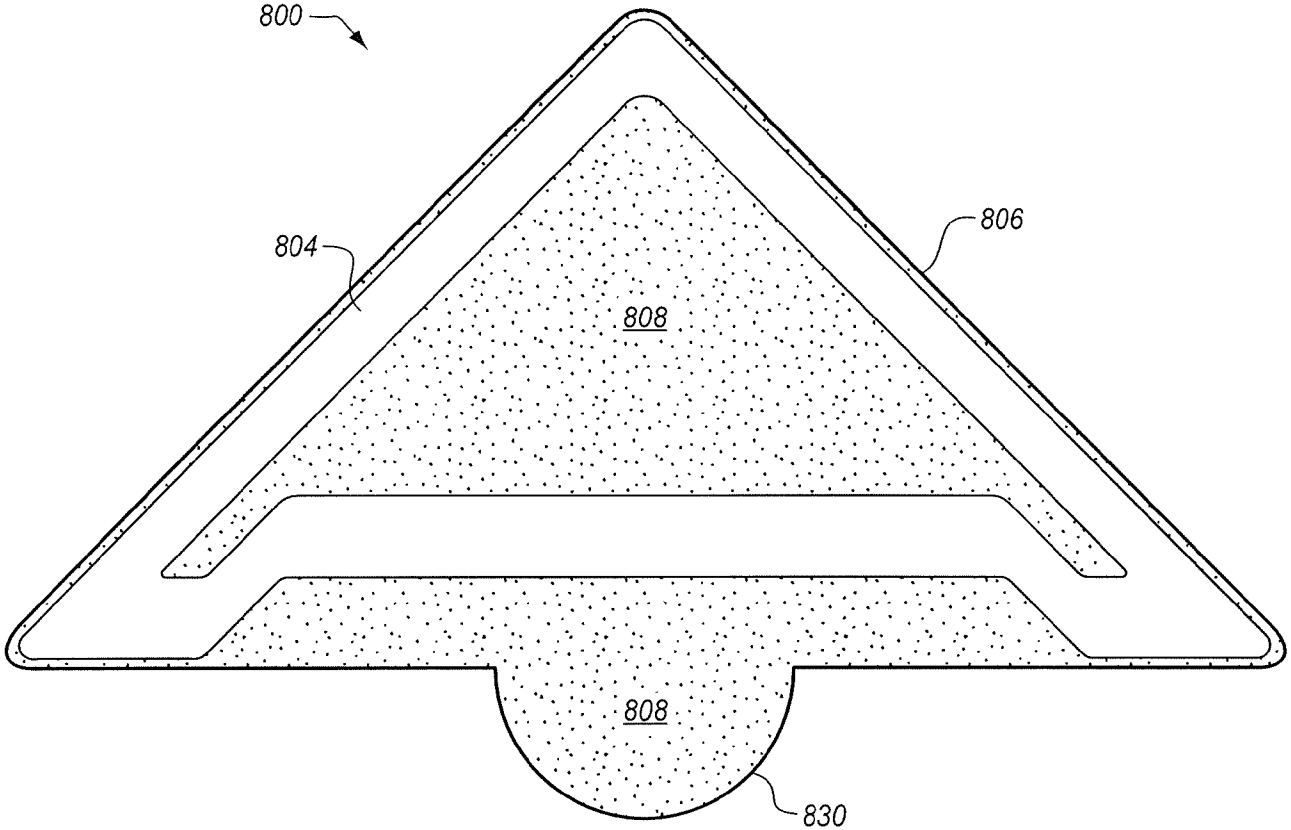
FIG. 8 is a cross-sectional view of an embodiment of a flood control apparatus that includes a trench portion.

FIG. 8 is a cross-sectional view of an embodiment of a flood control apparatus 800 that includes a trench portion 830. The flood control apparatus includes a generally triangular shaped support structure (e.g., an A-frame) 804 and one or more sheets 806 coupled with the support structure. Earth 808 fills the interior space within the apparatus.

As shown, the apparatus has a trench portion 830 filled with earth 808. The trench portion is intended to lie below ground level when the support structure is placed at ground level. As shown, the trench portion may include an extra portion of the one or more sheets in a half cylindrical shape aligned with the longitudinal axis of the apparatus (into the page as shown). Alternatively, the trench portion may have a square, rectangular, triangular, irregular, or other cross-sectional shape.

One potential advantage of the trench portion is that it may help to reduce flow of water underneath the flood control apparatus. Another potential advantage is increased stability or footing for the apparatus.

Figure 9A:
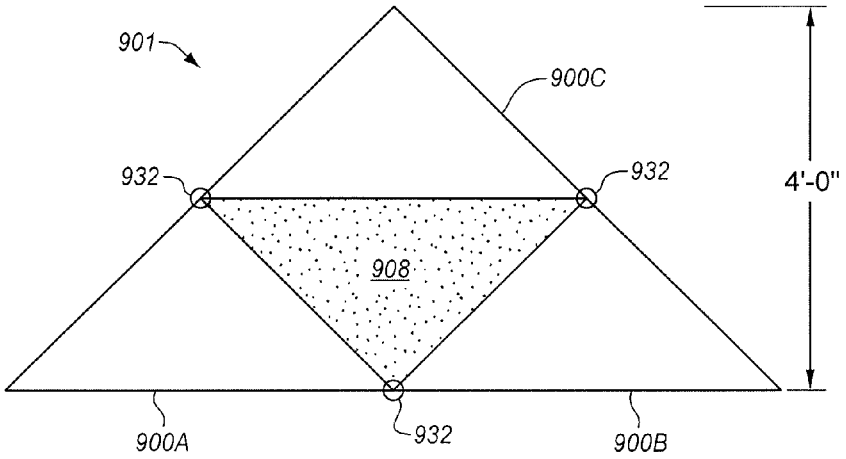
FIGS. 9A-B show that multiple flood control apparatus may be stacked according to an embodiment.
Figure 9B:
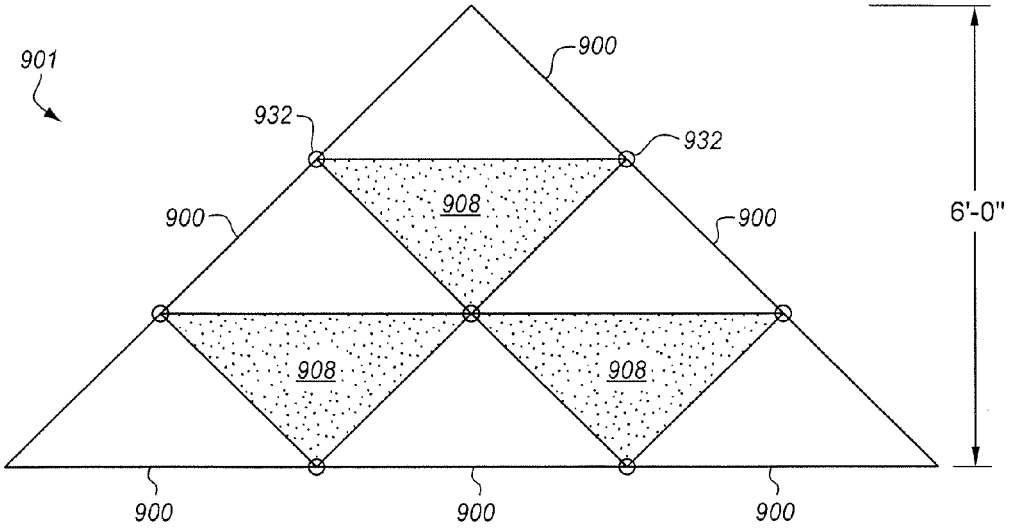

FIGS. 9A-B show that multiple flood control apparatus may be stacked according to an embodiment.

FIG. 9A is a simplified cross-sectional view of an embodiment of a flood control apparatus 901 showing that three flood control apparatus 900A, 900B, 900C may be formed into a generally triangular shaped stack having a greater height and width. First and second flood control apparatus 900A, 900B may be assembled and filled with earth aligned in a longitudinal direction in close proximity in some cases so that their feet touch or nearly touch. Then earth 908 may be filled in a generally V-shaped valley between the first and second flood control apparatuses until a nearly coplanar upper surface is achieved. Then a third flood control apparatus 900C may be stacked on top of the resulting structure. In particular, the third flood control apparatus may be assembled and filled with earth over the earth filled V-shaped valley between the first and second flood control apparatus. All three flood control apparatus may be aligned in the longitudinal direction.

Connectors 932 may be used to increase the stability or strength of the stacked flood control apparatus. In one or more embodiments, the connectors may be located at the corners of the generally triangular shaped transverse support structures. Examples of suitable connectors include, but are not limited to, male-female connectors, snap-on connectors, opposed surfaces or structures clamped, bolted, or otherwise fastened together, and the like.

One potential advantage of such stacking of flood control apparatus is that the overall height of the resulting flood control apparatus may be increased, such as, for example, at least about doubled. Another potential advantage is that the area of the base may also be increased, such as, for example at least about doubled.

FIG. 9B is a simplified cross-sectional view of an embodiment of a flood control apparatus 901 having six flood control apparatus 900 stacked in three levels. The additional level of stacking provides even greater height and base for footing.

The apparatus disclosed above have primarily been described as flood control apparatus. However, the apparatus are not limited to flood control. In other aspects, the apparatus may also optionally be used as berms to control erosion or surface runoff by reducing velocity of water or redirecting water. In still other aspects, the apparatus may optionally be used as fortifications deployed around houses, buildings, foxholes, etc. Still other uses will be apparent to those skilled in the art and having the benefit of the present disclosure.

Figure 9C:
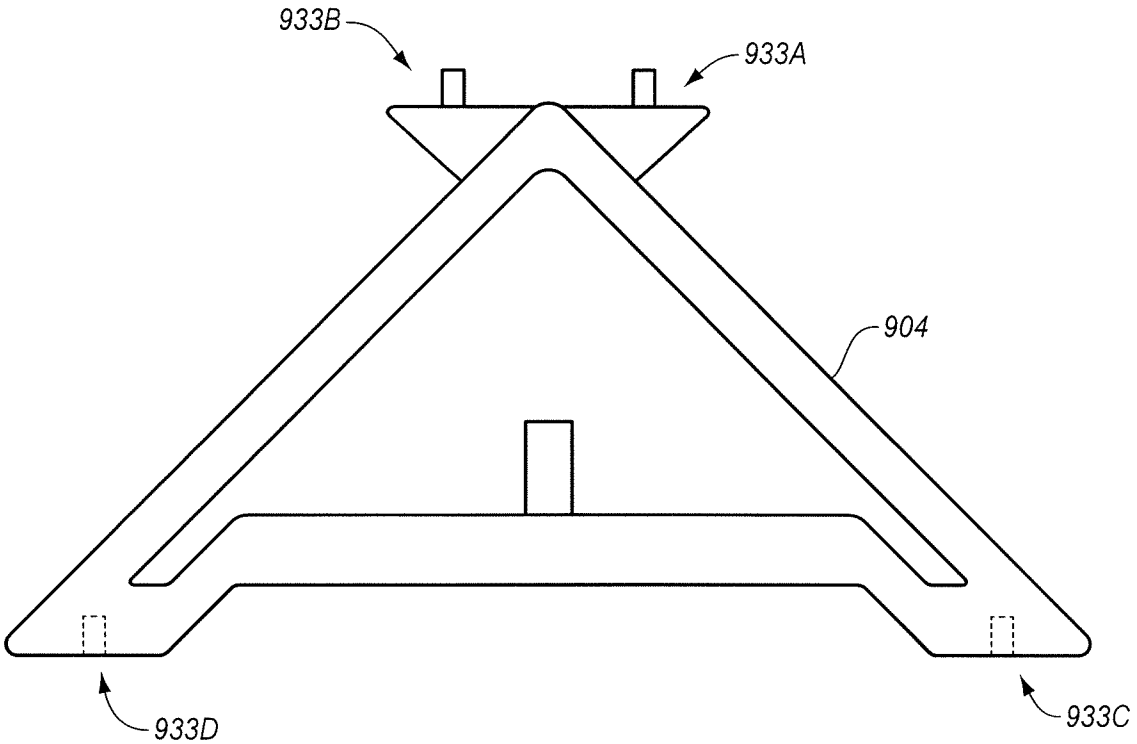
FIG. 9C is a side view of an embodiment of a support structure having connectors according to an embodiment.

FIG. 9C is a side view of an embodiment of a support structure 904 having connectors 933A, 933B according to an embodiment. The connectors are located near a top of the support structure. The illustrated connectors are male connectors one or more of which may be coupled or mated with corresponding female connectors at the base of one or more other overlying support structures. The illustrated support structure has female connectors 933C, 933D also at its base.

Figure 10:
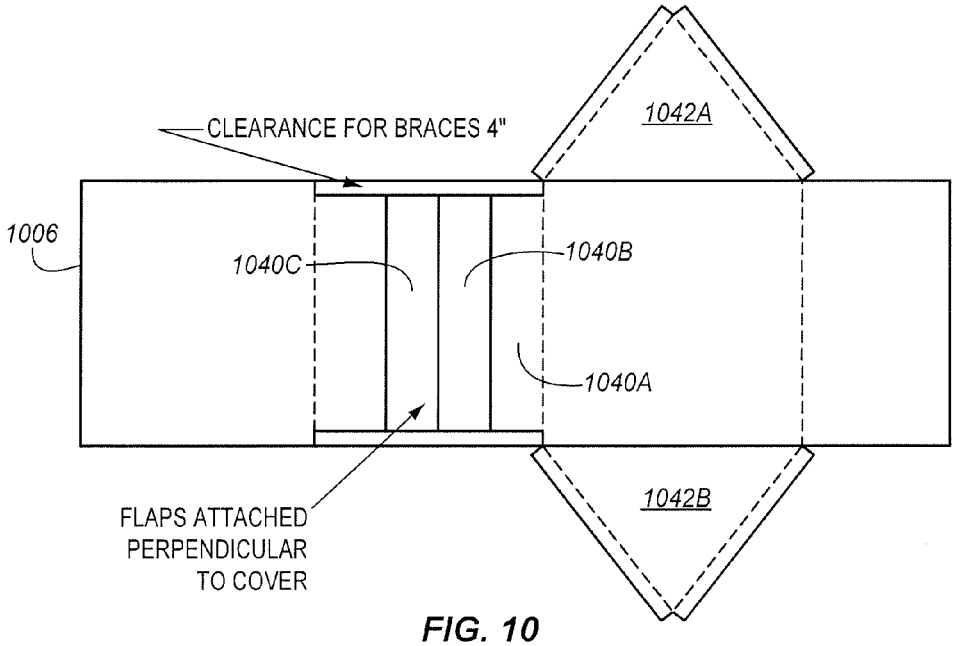
FIG. 10 is top planar view of an embodiment of a shaped sheet of material having a plurality of flaps, which may be wrapped around or otherwise coupled with a structural frame.

FIG. 10 is top planar view of an embodiment of a shaped sheet of material 1006 having a plurality of flaps 1040A, 1040B, 1040C that may be wrapped around or otherwise coupled with a structural frame (not shown in this view). The shaped sheet of material is generally flat and has a main portion that has a generally rectangular shape. Two generally triangular protrusions 1042A, 1042B protrude from the generally rectangular shaped main portion. The two generally triangular protrusions correspond to, and are used to cover, two transverse ends of the structural frame. In the illustration, dashed lines show locations where the sheet of material may be bent or folded around a structural frame. The structural frame may be aligned between the two generally triangular protrusions of the sheet of material. As shown, in one or more embodiments, the sheet of material optionally has three flaps 1040A, 1040B, 1040C, although fewer or more flaps may optionally be included. The flaps are optional and not required. The flaps include generally rectangular smaller sections of material that are sewn or otherwise attached to the generally main portion of the sheet of material. The flaps may be separately moved or pivoted about the main sheet of material to which they are attached. The flaps may be moved to project or protrude from the main sheet of material.

Figure 11:
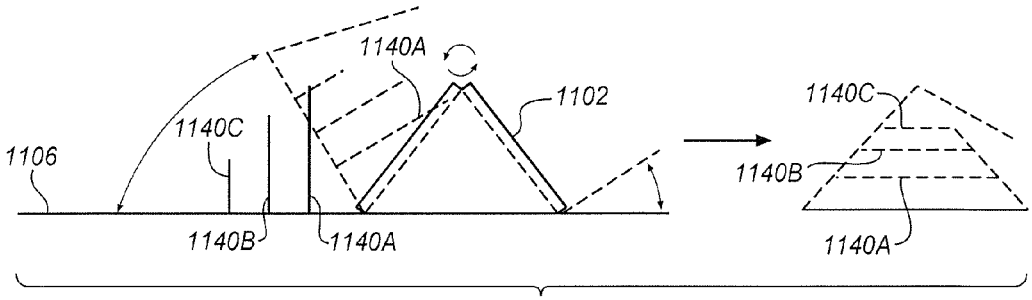
FIG. 11 is a cross-sectional view illustrating an embodiment of a sheet of material, which may be similar to that of FIG. 10, being applied around a structural frame.

FIG. 11 is a cross-sectional view illustrating an embodiment of a sheet of material 1106, which may be similar to that of FIG. 10, being applied around a structural frame 1102. In the illustration, a set of solid lines show the sheet of material in an initial position lying on the ground beneath the structural frame with the structural frame generally aligned between the two generally triangular protrusions of the sheet of material. The sheet of material has a plurality of flaps 1140A, 1140B, 1140C. To facilitate their illustration, the flaps are shown sticking up in the air perpendicular to the horizontal sheet of material, although the flaps would typically lie flat until lifted. As shown, as viewed, a portion of the sheet of material to the left of the structural frame may be wrapped or coupled around the structural frame in a generally clockwise direction. Similarly, as viewed, a portion of the sheet of material to the right of the structural frame may be wrapped or coupled around the structural frame in a generally counterclockwise direction. A set of dashed lines in the leftmost illustration show the sheet of material in an intermediate position. To facilitate their illustration, the flaps are again shown sticking out perpendicular, although this is a somewhat artificial position. The rightmost illustration shows the sheet of material almost entirely wrapped or coupled around the structural frame. Notice that each of the three flaps lie horizontally across earth within the interior of the flood control apparatus. The flaps generally help to stabilize, support, and/or protect the earth within the interior.

Figure 12:
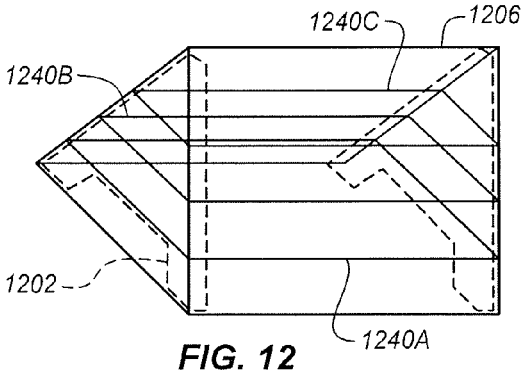
FIG. 12 is a perspective view illustrating an embodiment of a sheet of material, which may be similar to that of FIG. 10, wrapped or coupled around a structural frame.

FIG. 12 is a perspective view illustrating an embodiment of a sheet of material 1206, which may be similar to that of FIG. 10, wrapped or coupled around a structural frame 1202. Flaps 1240A, 1240B, 1240C are also shown and lie horizontally over earth within the interior of the apparatus at different levels or heights.

Figure 13:
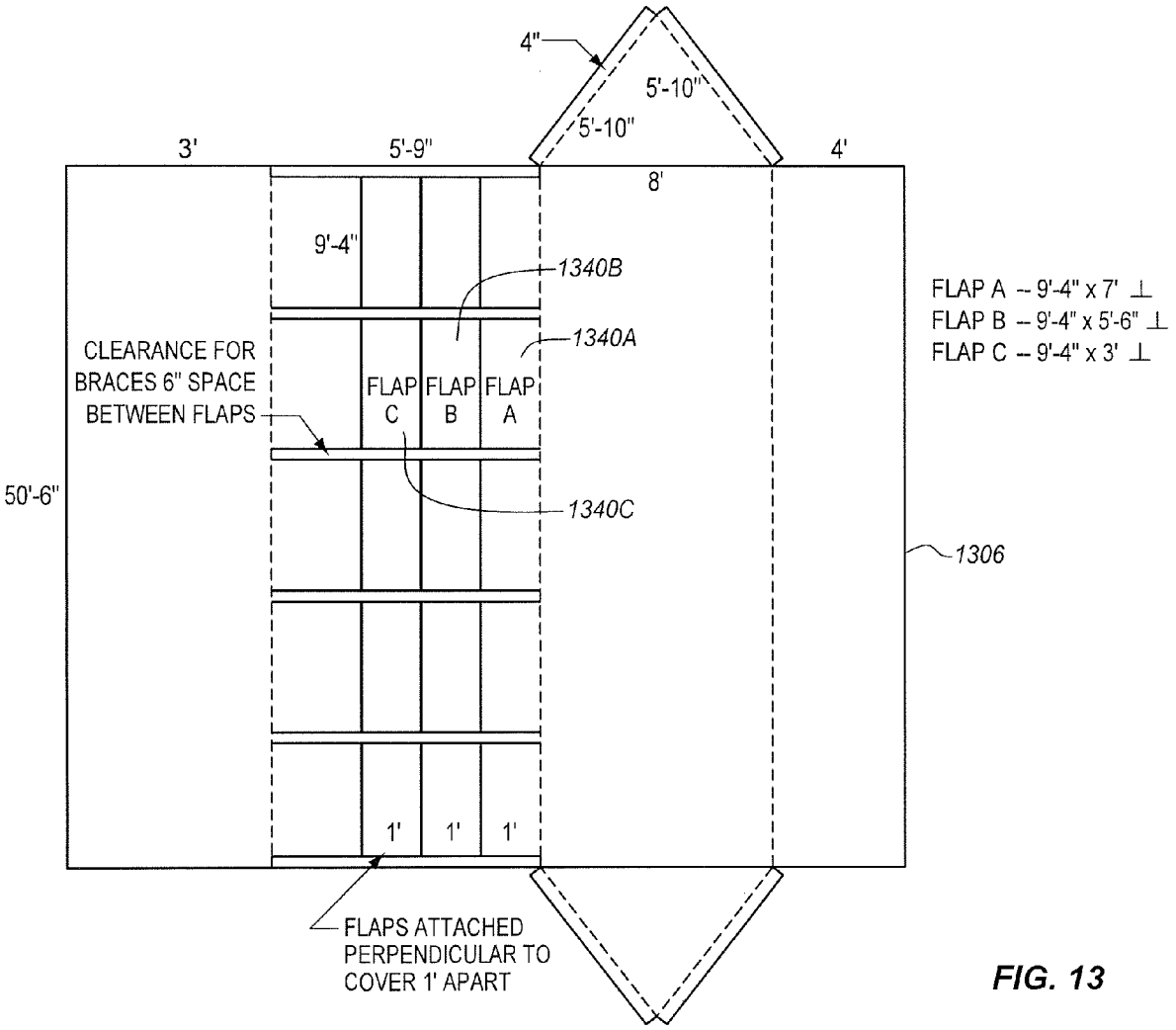
FIG. 13 is top planar view of an embodiment of a shaped sheet of material having a plurality of flaps that may be wrapped around or otherwise coupled with a structural frame.

FIG. 13 is top planar view of an embodiment of a shaped sheet of material 1306 having a plurality of flaps 1340A, 1340B, 1340C that may be wrapped around or otherwise coupled with a structural frame (not shown in this view). The sheet of material described immediately above was for a shorter length (e.g., the length between two support structures). The presently illustrated sheet is for a longer length spanning multiple support structures. In the illustrated embodiment, the sheet may span six support structures. Five sets of flaps are shown, with spaces (e.g., several inches) between each set of flaps to accommodate a transverse support structure. Examples of one possible set of dimensions are shown in the illustration, although the scope of the invention certainly is not limited to these particular dimensions.

In one or more embodiments, one or a plurality of support structures, optionally one or a plurality of braces, one or a plurality of sheets of material, and/or one or more other components of a flood control apparatus as disclosed herein may be included in a flood control kit. Other optional components that may optionally be included in the kit may include shovels or other earth moving devices, work gloves, staples or other fasteners, etc. The flood control kit may optionally be sealed in a manufacturers sealed package, such as a box, crate, or the like, or may be provided loose but together, as in the bed of a truck or vehicle. The components may be in unassembled or partly assembled form. The components may be similar to or the same as those disclosed elsewhere herein. The kit may also optionally include instructions to assemble and/or otherwise use the flood control apparatus as described elsewhere herein. The instructions may be paper instructions, or instructions on a compact disc or other machine-readable medium. The instructions may include written text, pictures, diagrams, figures, drawings, written procedures, audio instructions, video instructions, etc., and combinations thereof.

In the description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

In the description above, for the purposes of explanation, numerous specific details have been set forth in order to provide a thorough understanding of the embodiments of the invention. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description.

It will also be appreciated, by one skilled in the art, that modifications may be made to the embodiments disclosed herein, such as, for example, to the sizes, shapes, configurations, forms, functions, materials, and manner of operation, and assembly and use, of the components of the embodiments. All equivalent relationships to those illustrated in the drawings and described in the specification are encompassed within embodiments of the invention.

For simplicity and clarity of illustration, elements illustrated in the figures have not necessarily been drawn to scale. For example, the dimensions of some of the elements are exaggerated relative to other elements for clarity. Further, where considered appropriate, reference numerals or terminal portions of reference numerals have been repeated among the figures to indicate corresponding or analogous elements, which may optionally have similar characteristics.

Various operations and methods have been described. Some of the methods have been described in a basic form, but operations may optionally be added to and/or removed from the methods. The operations of the methods may also often optionally be performed in different order. Many modifications and adaptations may be made to the methods and are contemplated.

It should also be appreciated that reference throughout this specification to "one embodiment", "an embodiment", or "one or more embodiments", for example, means that a particular feature may be included in the practice of the invention. Similarly, it should be appreciated that in the description various features are sometimes grouped together in a single embodiment, Figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

What is claimed is:

1. A flood control apparatus comprising:

a structural frame, the structural frame having an elongated length in a longitudinal direction and a generally triangular shape in a transverse direction;

the structural frame including a plurality of generally triangular shaped transverse support structures that are generally aligned in the transverse direction and that are spaced apart in the longitudinal direction, wherein the plurality of generally triangular shaped transverse support structures comprise a plurality of A-frames, wherein each of the A-frames has two legs that are coupled at the top and diverge downward at an angle relative to one another and a crossmember connecting bottom portions of the legs with one another, wherein each of the A-frames has a plurality of pivot joints to allow the A-frame to fold from an open configuration to a closed position, the structural frame including one or more longitudinal connecting structures that are generally aligned in the longitudinal direction and that couple the plurality of generally triangular shaped transverse support structures together, wherein the one or more longitudinal connecting structures comprise a brace connecting crossmembers of a plurality of the A-frames, wherein the brace is capable of being coupled and decoupled from the crossmembers, wherein the one or more longitudinal connecting structures comprise a brace connecting crossmember of the plurality of the A-frames, and wherein the plurality of A-frames are pivotely connected with the longitudinal connecting structures;

one or more sheets of material coupled to holes formed in the structural frame by male members inserted into the holes formed in the structural frame, wherein the one or more sheets of material coupled to the structural frame comprise a trench portion formed of the one or more sheets of the material at a bottom of the apparatus between each of the two legs of each of the A-frames that is to lie below ground level when the A-frames are placed at ground level;

an inner region of the apparatus that is enclosed by the one or more sheets of material coupled to the structural frame to receive earth therein, wherein the trench portion is to be filled with earth.

2. The flood control apparatus of claim 1, further comprising male and female connectors of the brace and the crossmembers being coupled together.

3. The flood control apparatus of claim 1, wherein the elongated length is at least 100 feet, wherein a width of the apparatus in the transverse direction ranges from 2 to 10 feet, wherein a height of the apparatus ranges from 1 to 6 feet, and wherein a ratio of the width to the height ranges from 1.5 to 3.5.

4. A flood control apparatus comprising:

a structural frame, the structural frame having an elongated length in a longitudinal direction and a generally triangular shape in a transverse direction;

the structural frame including a plurality of generally triangular shaped transverse support structures that are generally aligned in the transverse direction and that are spaced apart in the longitudinal direction, wherein the plurality of generally triangular shaped transverse support structures have openings defined therein in legs thereof, the openings sized to receive a rigid panel coupled to adjacent generally triangular shaped transverse support structures, wherein the rigid panel is held in a place in the openings, wherein the rigid panel is coupled with at least one of the structural frame and the transverse support structures, wherein the rigid panel includes a sheet of material including at least one of wood, plywood, plastic, and metal, wherein a first generally triangular shaped transverse support structure having a connector to connect with a second generally triangular shaped transverse support structure such that the first and second generally triangular shaped transverse support structures are stacked over one another, wherein the connector includes a male connector or a female connector mated with an opposite form of connector associated with another overlying support structure;

the structural frame including one or more longitudinal coupling structures that are generally aligned in the longitudinal direction and that couple the plurality of transverse support structures together;

one or more sheets of material coupled to the structural frame;

an inner region of the apparatus that is enclosed by the one or more sheets of material coupled to the structural frame to receive earth therein.

5. The flood control apparatus of claim 4, wherein the one or more sheets of material are selected from one or more of woven polypropylene, woven plastic, polypropylene, un-woven flexible plastic, burlap, duck cloth, duck, canvas, canvas, cotton duck, woven cotton fabric, linen duck, jupe, fabric, and cloth.

6. The flood control apparatus of claim 4, wherein the one or more sheets of material are coupled to a generally triangular shaped transverse support structure through one or more of a hook-and-loop fastener, a rivot, a screw, and a bolt.

7. The flood control apparatus of claim 4, wherein the plurality of generally triangular shaped transverse support structures are coupled through one or more longitudinal coupling structures as a sawhorse.

8. The flood control apparatus of claim 4, further comprises a flood control kit having instructions to assemble another structural frame over the structural frame.

9. A flood control apparatus comprising:

a structural frame, the structural frame having an elongated length in a longitudinal direction and a generally triangular shape in a transverse direction;

the structural frame including a plurality of generally triangular shaped transverse support structures that are generally aligned in the transverse direction and that are spaced apart in the longitudinal direction, wherein a first generally triangular shaped transverse support structure comprises a connector at a top corner thereof, the connector at the top of the first generally triangular shaped transverse support structure connecting the first generally triangular shaped transverse support structure to a second generally triangular shaped transverse support structure that is stacked over the first generally triangular shaped transverse support structure, wherein the connector includes a male connector coupled to or mated with a female connector at a base of another overlying support structure;

the structural frame including one or more longitudinal coupling structures that are generally aligned in the longitudinal direction and that couple the plurality of transverse support structures together;

one or more sheets of material coupled to the structural frame;

an inner region of the apparatus that is enclosed by the one or more sheets of material coupled to the structural frame to receive earth therein.

10. The flood control apparatus of claim 9, wherein the one or more sheets of material are selected from one or more of woven polypropylene, woven plastic, polypropylene, un-woven flexible plastic, burlap, duck cloth, duck, canvas, canvas, cotton duck, woven cotton fabric, linen duck, jupe, fabric, and cloth.

11. The flood control apparatus of claim 9, wherein the one or more sheets of material are coupled to a generally triangular shaped transverse support structure through one or more of a hook-and-loop fastener, a rivot, a screw, and a bolt.

12. The flood control apparatus of claim 9, wherein the plurality of generally triangular shaped transverse support structures are coupled through one or more longitudinal coupling structures as a sawhorse.

13. The flood control apparatus of claim 9, further comprises a flood control kit having instructions to assemble another structural frame over the structural frame.

* * * * *